US006834983B1

(12) United States Patent
Guritz

(10) Patent No.: US 6,834,983 B1
(45) Date of Patent: Dec. 28, 2004

(54) COMBINATION LIGHTING FIXTURE WITH SWIVEL AND MOUNTING POST

(76) Inventor: Michael Lee Guritz, 8903 51st Ave., W, Bradenton, FL (US) 34210

( * ) Notice: Subject to any disclaimer, the term of this patent is extended or adjusted under 35 U.S.C. 154(b) by 0 days.

(21) Appl. No.: 10/145,925

(22) Filed: May 12, 2002

Related U.S. Application Data

(60) Provisional application No. 60/290,909, filed on May 15, 2001.

(51) Int. Cl.[7] ..... F21V 9/00

(52) U.S. Cl. ..... 362/287; 362/322; 362/324; 362/284; 362/282; 362/418

(58) Field of Search ..... 362/287, 427, 362/418, 153.1, 260, 322, 324, 284, 282

(56) References Cited

U.S. PATENT DOCUMENTS 6,170,965 B1 * 1/2001 Kotovsky ..... 362/371
6,227,902 B1 * 5/2001 Lin ..... 439/534
6,270,238 B1 * 8/2001 Mendelsohn et al. ..... 362/287
6,471,374 B1 * 10/2002 Thomas et al. ..... 362/285
6,530,680 B2 * 3/2003 Sipala ..... 362/398

* cited by examiner

*Primary Examiner*—Thomas M. Sember
(74) *Attorney, Agent, or Firm*—Dorothy S. Morse

(57) ABSTRACT

A lighting standard, and a method for its use, that has incorporated into its top end a swivel means for the adjustment of a lighting fixture head in train and elevation. The swivel means also incorporates passages through which electrical conductors are passed to provide power for the lighting fixture. The elevating member can include a fixture body, or in the alternative, the fixture body and elevating member can be separate components. The lower end of the standard can be buried in the ground, with the wiring necessary to power the fixture entering through the lower end of the standard and wiring terminations being made through a covered opening on the side of the standard. In the alternative, the standard can be connected directly to a junction box. Applications may include, but are not limited to, landscape lighting, accent lighting, and the lighting of signs, driveways, and walkways.

20 Claims, 4 Drawing Sheets

COMBINATION LIGHTING FIXTURE WITH SWIVEL AND MOUNTING POST

BACKGROUND RELATED APPLICATIONS

This application is based upon U.S. provisional patent application No. 60/290,909, filed on May 15, 2001, by the same inventor for the same invention, and the inventor respectfully requests all benefit to which he is entitled from this provisional patent application.

BACKGROUND

1. Field of Invention

This invention relates to outdoor fixtures for illuminating small areas, specifically to a lighting standard, and a method for its use, that has Incorporated into its top end a swivel means for the adjustment of a lighting fixture head in train and elevation. The swivel means also incorporates passages through which electrical conductors are passed to provide power for the lighting fixture. The elevating member can include a fixture body, or in the alternative, the fixture body and elevating member can be separate components. Further, the lower end of the standard can be buried in the ground, with the wiring necessary to power the fixture entering through the lower end of the standard and wiring terminations being made through a covered opening on the side of the standard. In the alternative, the standard can be connected directly to a junction box. When combined with fluorescent lamps, the present invention provides a clean, neat, compact, aesthetically pleasing, and easy-to-install lighting package for small areas that is energy efficient, has a low operating cost, has a heavy duty locking swivel for easy directional adjustment, and is made from corrosion proof and impact-resistant materials for rugged dependability. Applications may include, but are not limited to, landscape lighting, accent lighting, and the lighting of signs, driveways, and walkways.

2. Description of Prior Art

Landscape, accent, and sign lighting at night is common in both residential and commercial applications. Typically, small areas and signs are illuminated through the use of high-pressure sodium floodlights, metal halide floodlights, incandescent PAR floodlights, and quartz fixtures. Fluorescent lighting can also be used. The selection of small-area lighting fixtures appropriate for a given use is based upon a variety of factors, including initial fixture cost, fixture design, ease of fixture installation, aesthetic appeal of fixtures after installation, fixture impact resistance and durability, lamp life and replacement cost, and resistance of fixtures and lamps to weathering elements. Other use considerations include the number of fixtures required for visibility of a target area, the amount and cost of labor required for lamp replacement and other fixture maintenance, and lamp power consumption. When power consumption, lamp replacement cost, and labor cost for lamp maintenance are compared, the costs for operating the commonly used types of small-area lighting vary widely. The annual operating cost for two 70 W high-pressure sodium floodlights for sign illumination or accent use is calculated to be approximately $70, while the annual operating cost of two 175 W metal halide floodlights is computed at approximately $160. The annual operating cost of two 150 W incandescent PAR floodlights is even greater at approximately $178, with two 250 W quartz fixtures having the highest annual operating cost of approximately $260. In contrast, when used with fluorescent lighting, the present invention can provide comparable nighttime visibility of small areas with an annual operating cost for two such lamps being calculated at approximately $32. When compared to the clean, neat, compact, aesthetically pleasing, easy-to-install, energy efficient, low operating cost, ease of directional adjustability, corrosion resistance, impact resistance, and rugged dependability of the present invention, no known lighting package combination has all of the advantages of the present invention.

SUMMARY OF INVENTION OBJECTS AND ADVANTAGES

The primary object of this invention is to provide a lighting fixture primarily for outdoor use in illuminating small areas that has a combination of aesthetically pleasing design and rugged dependability. It is also an object of this invention to provide a lighting fixture that is easy to install. A further object of this invention is to provide a lighting fixture having a low operating cost. It is also an object of this invention to provide a lighting fixture that is low maintenance. A further object of this invention is to provide a lighting fixture that is compact in configuration with easy directional adjustment. It is also an object of this invention to provide a lighting fixture that can be adapted for use in providing overhead illumination, as well as illumination on a targeted object from below. A further object of this invention is to provide a lighting fixture that resists weathering elements for extended use. It is also an object of this invention to provide a lighting fixture that has a design easily allowing the position of the light head to become permanently fixed at any time during its use.

As described herein, properly manufactured and installed, the present invention would provide a lighting fixture that is rotatable through a wide arc to assist in the directional adjustment of emitted light within the area targeted for illumination. An opening in the side of the vertical post provides access to the wiring terminations after fixture installation without disturbing the initial aiming of the light or otherwise affecting its installation. One present invention lighting fixture set approximately three to five feet from a sign face, can illuminate areas on the sign face up to approximately ten feet wide and ten feet high. Additional present invention lighting fixtures evenly spaced apart from one another, and set approximately five to six feet from a sign face, can also illuminate areas on the sign face up to approximately ten feet high, with two such lighting fixtures being able to illuminate sign faces having a width dimension between approximately twelve and thirty feet, with four present invention lighting fixtures being preferred to illuminate sign faces having a width dimension between approximately thirty and forty feet. Embodiments having corrosion resistant fixtures and vertical posts made from stainless steel and aluminum are particularly suited for coastal environments. The fluorescent lamps optionally used as part of the present invention typically have a lamp life of approximately 10,000 hours, which reduces the labor required for lamp exchange. Ground installation of the present invention is easy. First, a vertical post having a length dimension appropriate to the intended use is selected, and the cover over its access opening is removed. The distal end of a power supply wire adapted for providing electricity for the present invention fixture is inserted upwardly through its vertical post, until the distal end of the wiring extends beyond the upper end of the vertical post. Preferably the remaining portion of the power supply wire is buried underground. Thereafter, the lower end of the vertical post is placed into the ground with its upper end at a pre-selected height dimension. The vertical post is then backfilled to secure it in a substantially upright position. Using quick-connect wire connectors, like wires in the power supply wire and lighting fixture are connected together. A light head with at least one fluorescent lamp is then pushed onto the upper end of the backfilled vertical post, and the light head oriented for optimum illumination of a targeted sign, object, or landscape feature. After the light head is properly aimed, a tool is placed through the access opening in the vertical post to tighten a draw bolt therein. Although not limited thereto, it is preferred for the draw bolt to comprise a socketed cap screw or a hex bolt. Tightening of the draw bolt would continue until movement of the light head is restricted, thereafter an additional one-fourth turn in the tightening direction would be added. When the access cover is replaced, installation is complete. A change in the directional adjustment of the light head can be easily accomplished at any time, by removing the access cover, loosening the draw bolt, placing the light head into a new orientation, tightening the draw bolt, and reattaching the access cover. However, any position of the light head can easily be made permanent through application of plastic pipe cement to the rotating members. When compact fluorescent lamps are used with the present invention, the light spread is more uniform as the compact fluorescent lamps are linear and not a point light source. The result is a more easily read or observed illuminated object. In the alternative, the present invention can be mounted in a conventional manner to any junction box. A junction box connection would be used to provide overhead sign illumination. The light head providing overhead illumination is aimed in the same easy manner, through use of a draw bolt, as those present invention lighting fixtures installed in the ground. A wedge with wiring passages therethrough can be used to provide safe passage of the power supply wires within the vertical post. Also, more than one vertical post can be used to support and aim larger lighting fixtures. Further, the vertical post can be lengthened or shortened so that the present invention lighting fixtures can be adapted to a wide variety of applications. The present invention includes a swivel means at the top end top end of a vertical post for the adjustment of a lighting fixture head in train and elevation. The elevating member can include a fixture body, or in the alternative, the fixture body and elevating member can be separate components. The vertical post also includes an area for the termination of wires for its fixture, and may also be configured to accommodate the termination of wires for an adjacent fixture. A split expansion sleeve and sealing ring can also be used within the vertical post for additional assistance and security in directional aiming of the lighting head. When combined with fluorescent lamps, the present invention provides a clean, neat, compact, aesthetically pleasing, and easy-to-install lighting package for small areas that is energy efficient, has a low operating cost, has a heavy duty locking swivel for easy directional adjustment, and is made from corrosion proof and impact-resistant materials for rugged dependability. Applications may include, but are not limited to, landscape lighting, accent lighting, and the lighting of signs, driveways, and walkways. No device is known with all of the advantages of the present invention.

The description herein provides the preferred embodiment of the present invention but should not be construed as limiting the scope of the lighting fixture invention. For example, variations in the length and wall thickness dimensions of the vertical post; the size dimension of the elevating member; the thickness dimension of the wedge; the length dimension of the draw bolt; the type of locking means used to secure the draw bolt to the elevating member, and the positioning of the wire passage through the wedge; other than those shown and described herein may be incorporated into the present invention. Thus the scope of the present invention should be determined by the appended claims and their legal equivalents, rather than being limited to the examples given.

DETAILED DESCRIPTION OF PREFERRED EMBODIMENTS

Figure 1:
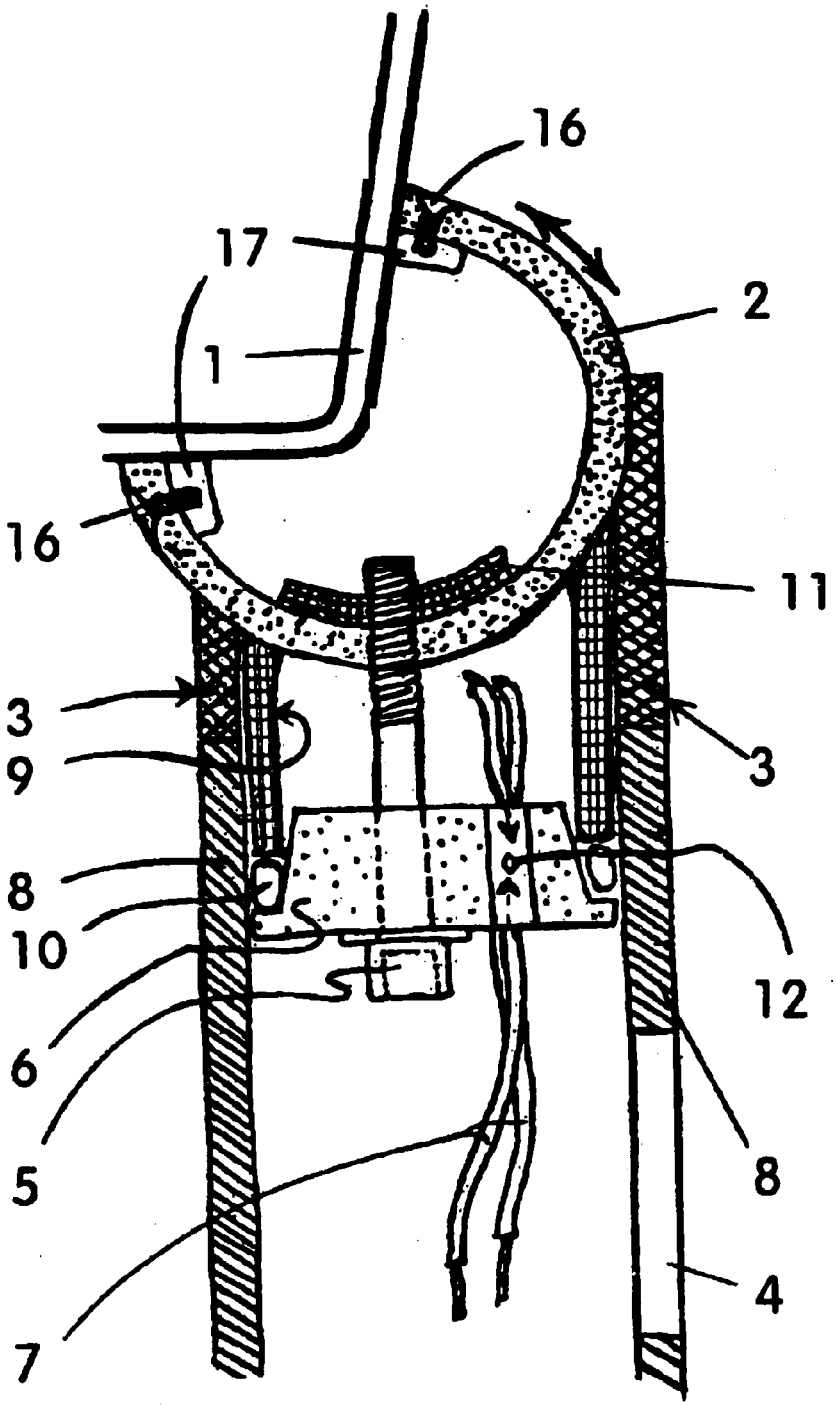
FIG. 1 is a sectional view of a first embodiment of the present invention having a lighting fixture body mounted on an elevating member that rotates in a vertical plane, with the elevating member being cradled on a rotating member that rotates the lighting fixture body and elevating member in a horizontal plane, a vertical post with an access opening positioned beneath the rotating member, a split expansion sleeve extending into the bores of the vertical post and the rotating member to hold the rotating member in line with the vertical post, a wedge with a wire passage and a draw bolt aperture positioned within the vertical post, a sealing ring positioned between the wedge and the vertical post under the split expansion sleeve, and a draw bolt extending through the wedge and the elevating member while being secured in place with a threaded locking nut.
Figure 4:
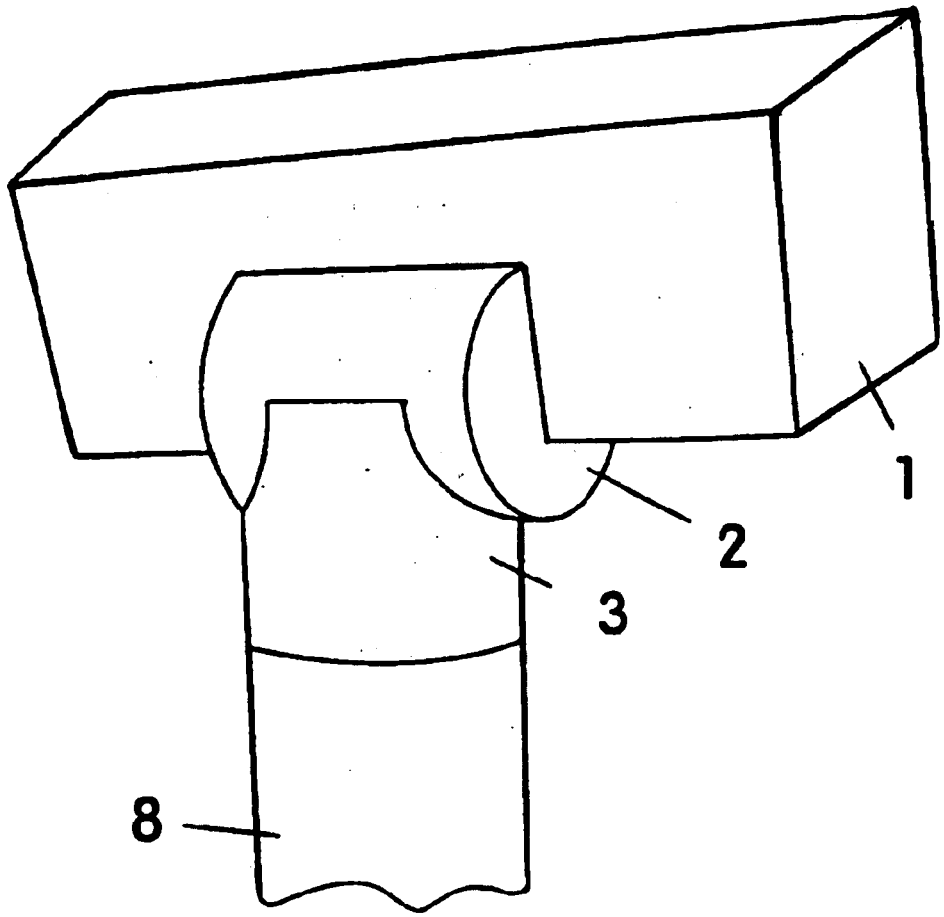
FIG. 4 is a rear perspective view of the first embodiment of the present invention.

FIG. 1 and 4 show a first embodiment of the present invention having a lighting fixture body 1 mounted on an elevating member 2 that rotates in a vertical plane, elevating member 2 being cradled on a rotating member 3 that allows for rotation of lighting fixture body 1 and elevating member 2 in a horizontal plane. The size of elevating member is not critical as long as it is appropriate to the size and configuration of lighting fixture body 1 used. A vertical post or tube 8 supports rotating member 3 and has an access opening 4 positioned at a spaced-apart distance from rotating member 3 for operator access to wiring terminations without disturbing the pre-set orientation of lighting fixture body 1. FIG. 1 also shows the first embodiment of the present invention having a split expansion sleeve 9 extending respectively into the central bores of vertical post or tube 8 and rotating member 3 to hold rotating member 3 in line with vertical post or tube 8. FIG. 1 further shows the first embodiment of the present invention having a wedge 6 with a wire passage 12, and draw bolt 5 extending through wedge 6 so that its threaded distal end can be secured by use of a threaded locking nut 11, or other locking means, to elevating member 2. Although not limited thereto, it is preferred for draw bolt 5 to comprise a socketed cap screw or a hex bolt. The length dimension of draw bolt 5 and thickness dimension of wedge 6 are not critical. However, draw bolt 5 must have sufficient length dimension in proportion to wedge 6 to extend through wedge 6, rotating member 3 and elevating member 2, and become secured with locking nut 11 without interfering with the mounting or operation of lighting fixture body 1. Also, the configuration of lighting fixture body 1 may vary, and is not limited to that shown in FIG. 1. An optional sealing ring 10 can also be positioned between wedge 6 and vertical post 8, shown in FIG. 1 positioned below split expansion sleeve 9. During use, lighting fixture body 1 can be rotated in train and elevation to a desired position, after which draw bolt 5 is tightened to lock lighting fixture body 1 temporarily into the selected position. Access to draw bolt 5 is provided through the access opening 4 in vertical post or tube 8. Access opening 4 must be sufficiently large to accommodate the use of a wrench or other loosening and/or tightening tool (not shown). Access opening 4 also provides operator access to the wiring terminations after fixture installation without disturbing the initial aiming of the lighting fixture body 1 or otherwise affecting its installation. In most applications, although not limited thereto, it is contemplated for draw bolt 5 to extend centrally through wedge 6 with wire passage 12 positioned at a spaced-apart distance from draw bolt 5. Although not shown in FIG. 1, after installation of the present invention and directional aiming of fixture body 1, a cover plate secured by two screws is used to conceal access opening 4. The configuration of and materials from which the cover plate is made, and the type and number of screws used to secure it to vertical post or tube 8, are not critical as long as the cover plate and screws are corrosion-resistant and impact-resistant and otherwise configured to protect the interior of vertical post or tube 8 from weathering elements. Tightening of draw bolt 5 draws wedge 6 into the central bore of split expansion sleeve 9, thereby enlarging the diameter of expansion sleeve 9 against the interior walls of rotating member 3 and vertical post or tube 8 to temporarily lock lighting fixture body 1 in a desired position of use. Locking nut 11 is threaded to receive the threaded distal end of draw bolt 5, and as a result of its location draws elevating member 2 snugly against rotating member 3 when draw bolt 5 is tightened. At the same time draw bolt 5 drives tapered wedge 6 into split expansion sleeve 9, which causes the diameter of split expansion sleeve 9 to increase within the bore of vertical post or tube 8, thereby locking all members together. The configuration of locking nut 11 is not critical and can include any means of effectively tightening draw bolt 5. FIG. 1 further shows mounting reinforcements 17 and threaded fasteners 16 being used as a means of facilitating the connection between elevating member 2 and lighting fixture body 1, wiring 7 extending through the wire passage 12 in wedge 6, and a double-headed arrow indicating the multidirectional movement possible for elevating member 2.

Figure 2:
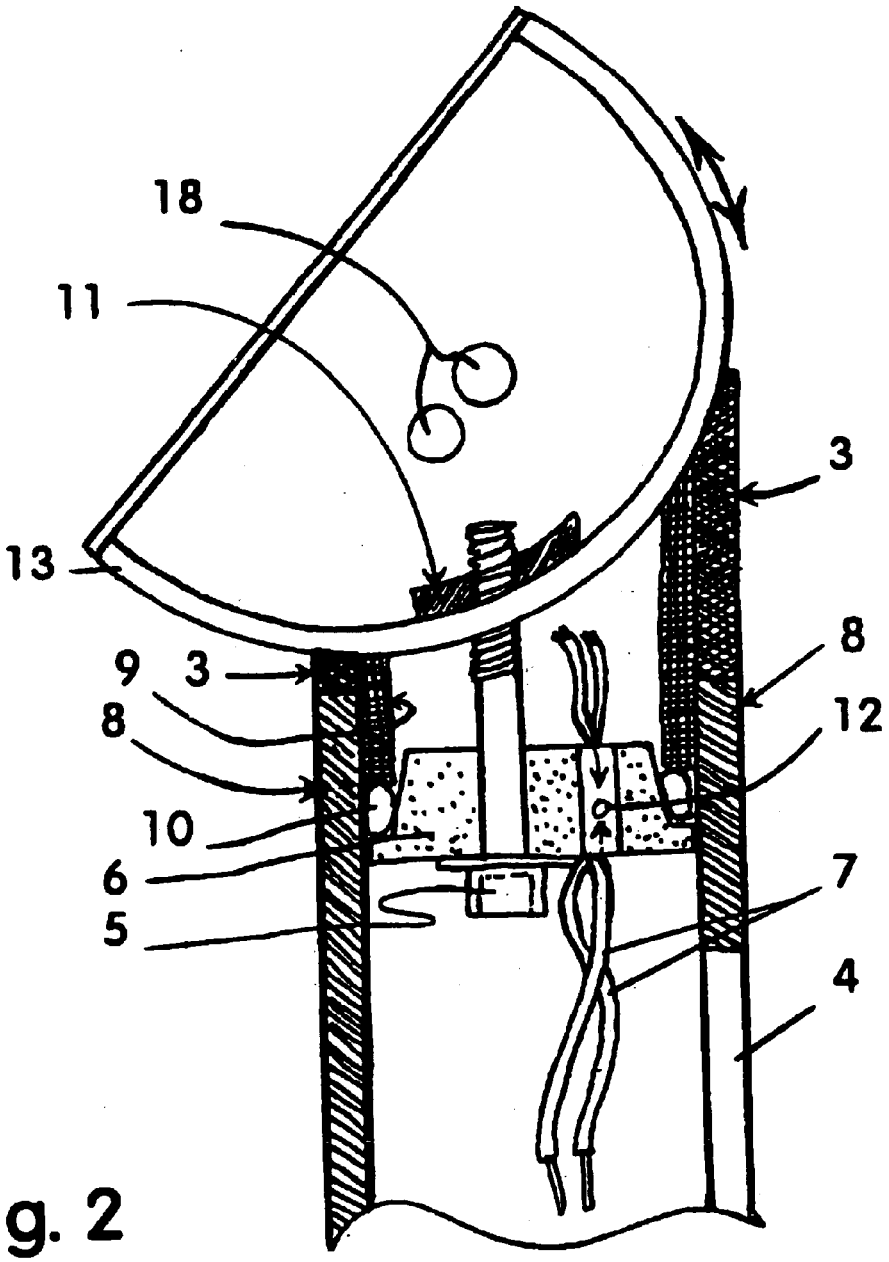
FIG. 2 is a sectional view of a second embodiment of the present invention having an enlarged, elevating member that functions as a combined fixture body and elevating member.

FIG. 2 shows a second embodiment of the present invention having an enlarged elevating member 13, which functions as a combined fixture body 1 and elevating member 2. The size of enlarged elevating member 13 is not critical and would be determined by the intended application. Also, it is contemplated for enlarged elevating member 13 to have various configurations and not be limited to that shown in FIG. 2. Although FIG. 2 shows two compact fluorescent lamps 18 positioned within enlarged elevating member 13, it is contemplated for enlarged elevating member 13 to comprise sufficient interior space to accommodate one or more compact fluorescent lamps 18 and associated ballast assemblies (not shown). Since enlarged elevating member 13 combines the functions of both lighting fixture body 1 and elevating member 2, one component of the assemblage in FIG. 1 is thereby eliminated and provides a cost savings. FIG. 2 also shows enlarged elevating member 13 being cradled on rotating member 3, vertical post or tube 8 supporting rotating member 3, an access opening 4 through vertical post or tube 8 at a spaced-apart distance from rotating member 3, a split expansion sleeve 9 extending respectively into the central bores of vertical post or tube 8 and rotating member 3 to hold rotating member 3 in line with vertical post or tube 8 when draw bolt 5 is tightened. FIG. 2 further shows the second embodiment of the present invention having a wedge 6 with a wire passage 12, and draw bolt 5 extending through wedge 6 so that its threaded distal end can be secured by use of a threaded locking nut 11, or other locking means, to enlarged elevating member 2. An optional sealing ring 10 can also be positioned between wedge 6 and vertical post 8. During use, enlarged elevating member 13 can be rotated in train and elevation to a desired position, after which draw bolt 5 is tightened to temporarily lock enlarged elevating member 13 into the selected position. Should permanent positioning be required for an intended application of the present invention, cementing means, such as but not limited to plastic pipe cement, can be applied to the rotating members. Access to draw bolt 5 is provided through the access opening 4 in vertical post or tube 8. Although not shown in FIG. 2, a cover plate secured by at least one screw would be used to conceal access opening 4. FIG. 2 further shows wiring 7 extending through wedge 6 and a double-headed arrow indicating the multi-directional movement possible for enlarged elevating member 13.

Figure 3:
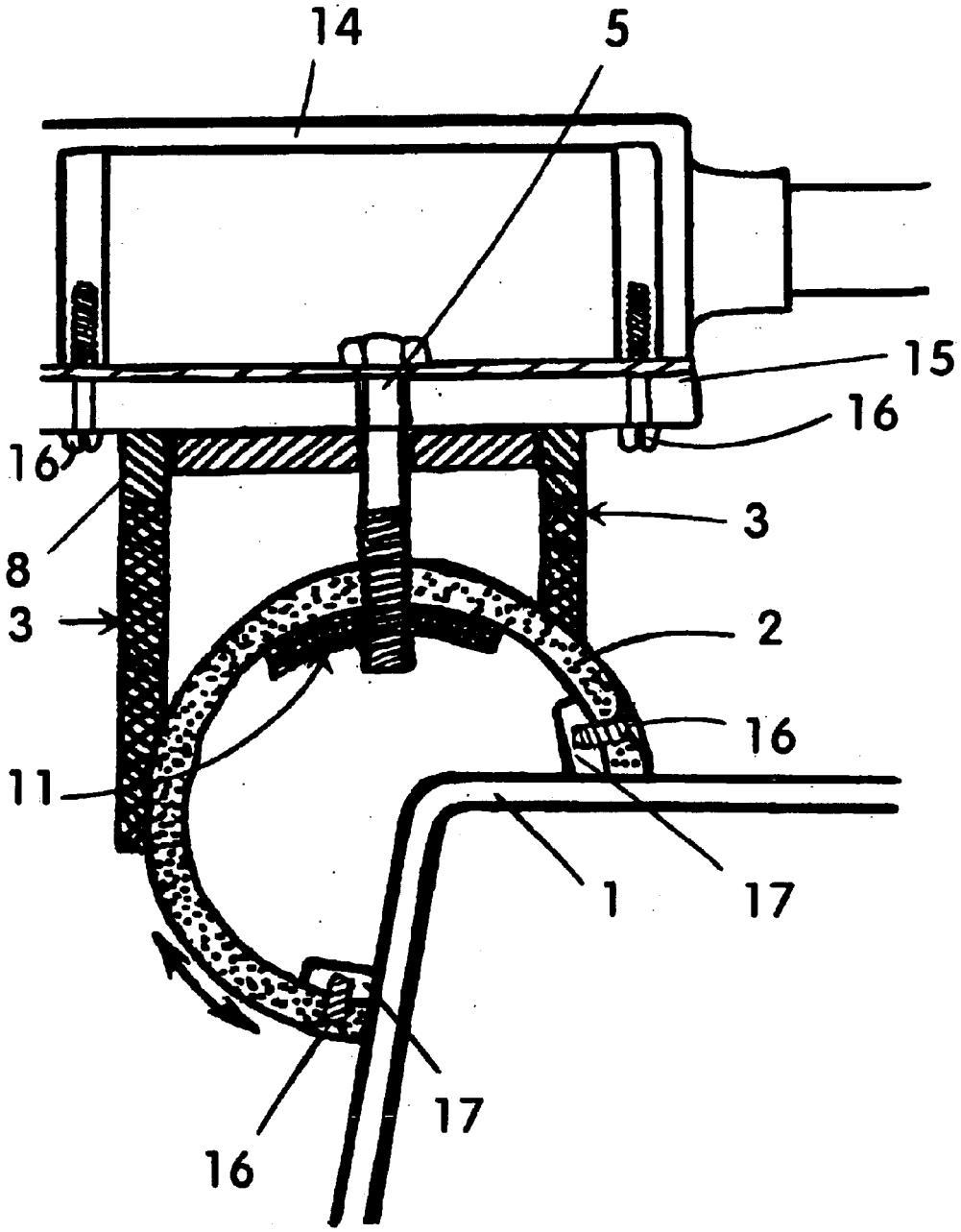
FIG. 3 is a sectional view of a third embodiment of the present invention having the elevating member directly connected to a junction box oriented for overhead lighting use.

FIG. 3 shows a third embodiment of the present invention having elevating member 2, rotating member 3, and post or tube 8 connected to a conventional junction box 14 through the use of a cover 15 and two threaded fasteners 16. The number and type of fasteners used for cover 15 are not critical. Since junction box 14 is in an inverted position, the third embodiment is configured for overhead lighting of a targeted object (not shown), such as a sign. The third preferred embodiment allows for rapid and economical, original or retrofit, installations. Mounting reinforcements 17 are provided for facilitating the connection between elevating member 2 and lighting fixture body 1. The configuration of lighting fixture body 1 is not limited to that shown in FIG. 3. Draw bolt 5 extends through cover 15, post or tube 8, rotating member 3, elevating member 2, and threaded locking nut 11. FIG. 3 further shows a double-headed arrow indicating the multi-directional movement possible for elevating member 2, however, wiring 7 is omitted from FIG. 3 for clarity and simplicity of illustration.

As examples of its use, but not limited thereto, one present invention lighting fixture set approximately three to five feet from a sign face (not shown), can illuminate areas on the sign face up to approximately ten feet wide and ten feet high. Additional present invention lighting fixtures evenly spaced apart from one another, and set approximately five to six feet from a sign face, can also illuminate areas on the sign face up to approximately ten feet high, with two such lighting fixtures being able to illuminate sign faces having a width dimension between approximately twelve and thirty feet, with four present invention lighting fixtures being preferred to illuminate sign faces having a width dimension between approximately thirty and forty feet. The compact fluorescent lamps 18 optionally used as light sources typically have a lamp life of approximately 10,000 hours, which reduces the labor required for lamp exchange. Further, ground installation of the present invention is easy, and one preferred method of ground installation follows. It should be noted that other methods and method variations not identified herein are also considered to be within the scope of the present invention. First, a vertical post or tube 8 having a length dimension appropriate to the intended use is selected, and the cover (not shown) over its access opening 4 is removed. The distal end of a power supply wire 7 adapted for providing electricity for the present invention fixture is inserted upwardly through its vertical post or tube 8, until the distal end of the wiring extends beyond the upper end of the vertical post or tube 8. Preferably the remaining portion of the power supply wire 7 is buried underground. Thereafter, the lower end of the vertical post or tube 8 is placed into the ground with its upper end at a pre-selected height dimension. The vertical post would preferably be backfilled to secure it in a substantially upright position. Using quick connect wire connectors (not shown), like wires in the power supply wire 7 are connected to light source 18. A lighting fixture body 1 with at least one compact fluorescent lamp 18 and associated ballast assembly (not shown) is then pushed onto the upper end of the backfilled vertical post or tube 8, and the oriented for optimum illumination of a targeted sign, object, or landscape feature (not shown). After the lighting fixture body 1 is properly aimed, a tool (not shown) is placed through the access opening 4 in vertical post or tube 8 to tighten draw bolt 5 therein. Tightening of draw bolt 5 would continue until movement of the lighting fixture body 1 is restricted, thereafter an additional one-fourth turn in the tightening direction would be added. When the access cover (not shown) is replaced, installation is complete. A change in the directional adjustment of the lighting fixture body 1 can be easily accomplished at any time, by removing the access cover, loosening draw bolt 5, placing the lighting fixture body 1 into a new orientation, tightening draw bolt 5, and reattaching the access cover. However, any position of the lighting fixture body 1 can be made permanent through application of plastic pipe cement (not shown), or other cementing means, to the rotating members. When a compact fluorescent lamp 18 is used with the present invention light spread is more uniform, resulting in a more easily read or observed illuminated object, as compact fluorescent lamps 18 are linear and not a point light source. As an alternative to ground installation, the present invention can be mounted in a conventional manner to any junction box, one application of a junction box 14 connection would be to provide overhead sign illumination. A lighting fixture body 1 used to provide overhead illumination is aimed in the same easy manner as those present invention lighting fixtures installed in the ground, through use of one or more draw bolts 5. A wedge 6 with is wiring passages 12 therethrough can be employed to provide safe passage of the power supply wires 7 extending through each vertical post or tube 8 used. It is contemplated for more than one vertical post or tube 8 to be used to support and aim larger lighting fixture bodies 1 or enlarged elevating members 13. Further, vertical post or tube 8 can be lengthened or shortened so that the present invention lighting fixtures can be adapted to a wide variety of applications. Also, the wall thickness dimension of vertical post or tube 8 is not critical, as long as it is appropriate to the intended application without adding unnecessary cost. The present invention includes a swivel means at the top end of a vertical post or tube 8 for the adjustment of a lighting fixture body 1 in train and elevation. The elevating member 2 can include a combined lighting fixture body 1 and elevating member 2, such as enlarged elevating member 13, or in the alternative, the lighting fixture body 1 and elevating member 2 can be separate components. Each vertical post or tube 8 used can also include an area for the termination of wires for its lighting fixture body 1, as well as an adjacent fixture. Further, a split sleeve 9 and sealing ring 10 can be used within the vertical post or tube 8 for additional assistance in directional aiming of lighting fixture body 1 or enlarged elevating member 13. When combined with compact fluorescent lamps 18, the present invention provides a clean, neat, compact, aesthetically pleasing, and easy-to-install lighting package for small areas that is energy efficient, has a low operating cost, has a heavy duty locking swivel for easy directional adjustment, and is made from corrosion proof and impact-resistant materials for rugged dependability. Applications may include, but are not limited to, original or retrofit installation for landscape lighting, accent lighting, and the lighting of signs, driveways, and walkways. Although not limited thereto, the preferred embodiments of lighting fixture body 1 would be made from injection molded ABS and vertical post or tube 8 from extruded PVC. For most preferred uses, lighting fixture body 1 and vertical post or tube 8 would be black, white or green, so as to be unobtrusive, however, color is not considered critical. The length and wall thickness dimensions of vertical post or tube 8 are not critical as long as it remains functional and cost effective. Although not shown, lighting fixture body 1 would require a lens cover, preferably made from injection molded clear polycarbonate, and could optionally comprise one or more colored lenses. Fluorescent lights 18 would preferably be 13-watt compact fluorescent lamps that draw one or two amps of current, and ballasts used would be 120-volt. Embodiments having corrosion resistant fixtures and vertical posts or tubes 8 made from stainless steel and aluminum are particularly suited for coastal environments.

What is claimed is:

1. A lighting fixture adapted for accent illumination of small areas, said lighting fixture comprising:

rigid tubing having a center bore, a proximal end, and a distal end;

a tubular rotating member having a first end and a second end, with said first end being connected to said distal end of said tubing, said rotating member also having a central bore aligned with said center bore of said tubing;

a quantity of electrical wiring;

an elongated draw bolt positioned centrally within said center and central bores, said draw bolt having a threaded end, an opposing end and securing means for said threaded end;

a tubular elevating member cradled for rotation by said second end of said rotating member, said elevating member also having at least one access opening for extension therethrough of said draw bolt and said electrical wiring, said elevating member further being secured against said second end of said rotating member by said draw bolt and said threaded end securing means so that said rotating and elevating members are fixed in position when said draw bolt is tightened with said securing means and movable relative to one another upon temporary loosening of said threaded end securing means relative to said draw bolt;

a lighting fixture body secured at least in part within said concave cross-sectional configuration whereby movement of said elevating member relative to said rotating member provides adjustment of said lighting fixture body in train and elevation;

at least one light source positioned within said lighting fixture body and in electrical communication with said electrical wiring;

stabilizing means adapted for fixing said proximal end of said tubing in a stationary position during use, and also adapted for providing connection of said electrical wiring to a source of electrical power sufficient to illuminate said at least one light source; and access means associated with said tubing and adapted for prompt user contact with said opposing end of said draw bolt to achieve elevational adjustment of said lighting fixture body, whereby when said electrical wiring is extended through said elevating member, extended through said central bore of said rotating member, extended through said central bore of said tube, and connected to a source of electrical power sufficient to illuminate said at least one light source, the direction of illumination provided by said at least one light source can be quickly and simply changed in elevation by using said access means to gain access to said draw bolt to loosen it, moving said elevating member relative to rotating member into a newly desired position, and thereafter using said access means to Rain access to said draw bolt to tighten it and again place said elevating member in a fixed position relative to said rotating member.

2. The lighting fixture of claim 1 wherein said elevating member and said lighting fixture body are combined into a single unit.

3. The lighting fixture of claim 1 wherein said stabilizing means for said proximal end of said tubing comprises a junction box and said access means comprises a cover that is easily removable from said junction box.

4. The lighting fixture of claim 1 wherein said stabilizing means for said proximal end of said tubing comprises said proximal end being placed into the ground and said access means comprises a side opening through said tubing.

5. The lighting fixture of claim 4 further comprising a wedge and an associated split expansion sleeve positioned within said center bore of said distal end of said tubing and said central bore of said rotating member, and wherein said draw bolt is placed through said and wedge used to enlarge said split expansion sleeve so as to temporarily lock said lighting fixture body into a desired position of use.

6. The lighting fixture of claim 5 further comprising a sealing ring in association with said split expansion sleeve.

7. The lighting fixture of claim 5 wherein said light source comprises at least one compact fluorescent lamp.

8. The lighting fixture of claim 4 further comprising cover plate means adapted for concealing said access side opening through said tubing.

9. The lighting fixture of claim 1 wherein said lighting fixture body, said tubing, said rotating member, and said elevating member all comprise corrosion proof and impact resistant materials for rugged dependability.

10. An outdoor lighting fixture adapted for accent illumination of small areas, said lighting fixture comprising:

a lighting fixture body;

a quantity of electrical wiring;

swivel means comprising rotating and elevating members adapted for adjustment of said lighting fixture body in train and elevation, said swivel means also being adapted for extension therethrough of said electrical wiring and said rotating member also having a central bore;

at least one light source positioned within said lighting fixture body and connected to said electrical wiring;

a draw bolt;

secured against said open front of said elevating member and being configured for electrical connection to said wiring;

securing means for said draw;

a split expansion sleeve within said central bore;

wedge means positioned within said central bore, said draw bolt being placed through said wedge means and used to enlarge said split expansion sleeve so as to lock said lighting fixture body into a desired position of use;

a sealing ring in association with said split expansion sleeve; and rigid tubing aligned with said central bore and adapted for support of said lighting fixture body and said swivel means, said tubing having an access opening adapted for operator access to said draw bolt, and further comprising a cover plate adapted for concealing said access opening wherein said swivel means can be used to aim said light source into a desired position of use and tightening of said draw bolt between said wedge and said elevating member locks said lighting fixture body and said light source into the desired position of use.

11. The lighting fixture of claim 10 wherein said elevating member and said lighting fixture body are combined into a single unit.

12. A method for accent illumination of small areas, said method comprising the steps of:

providing a lighting fixture body, a quantity of electrical wiring connected to a power supply and having a distal end, swivel means having a wire passage as well as rotating and elevating members, at least one light source, a bolt, draw bolt securing means, and mounting means;

fixing said mounting means in a desired position relative to an area targeted for accent illumination;

positioning said at least one light source within said lighting fixture body;

extending said distal end of said electrical wiring through said mounting means;

extending said distal end of said electrical wiring through said wire passage;

providing electrical connection between said electrical wiring and said at least one light source;

connecting said lighting fixture body to said swivel means;

directionally adjusting said swivel means in train and elevation to aim said lighting fixture body toward the are targeted for accent illumination; and using each said draw bolt and said draw bolt securing means to connect said swivel means to said mounting means and lock said lighting fixture body temporarily into a desired position of use.

13. The method of claim 12 wherein said elevating member and said lighting fixture body are combined into a single unit.

14. The method of claim 12 wherein said mounting means comprises a junction box and cover.

15. The method of claim 12 wherein said mounting means comprises rigid tubing with a central bore.

16. The method of claim 15 further comprising cover plate means for said tubing, wherein said tubing has an opening adapted for access to said draw bolt, and further comprising the step of securing said cover plate means against said tubing so as to conceal said opening.

17. The method of claim 15 further comprising the step of providing a wedge and an associated split expansion sleeve, as well as the steps of positioning said wedge and said split expansion sleeve within said central bore, placing said draw bolt through said wedge, and tightening said draw bolt whereby said wedge enlarges said split expansion so as to temporarily lock said lighting fixture body into a desired position of use.

18. The method of claim 17 further comprising a sealing ring for said wedge, and the step of placing said sealing ring within said tubing between said wedge and said split expansion sleeve.

19. The method of claim 12 wherein said lighting fixture body comprises corrosion proof and impact-resistant materials adapted for rugged dependability.whereby said wedge enlarges said split expansion so as to temporarily lock said lighting fixture body into a desired position of use.

20. The method of claim 12 further comprising the steps of providing cementing means and using said cementing means to permanently lock said swivel means into a single desired position if use.

* * * * *